US006333703B1

(12) United States Patent
Alewine et al.

(10) Patent No.: US 6,333,703 B1
(45) Date of Patent: Dec. 25, 2001

(54) AUTOMATED TRAFFIC MAPPING USING SAMPLING AND ANALYSIS

(75) Inventors: Neal J. Alewine, Lakeworth, FL (US); James C. Colson, Austin, TX (US); Abraham P. Ittycheriah; Stephane H. Maes, both of Danbury, CT (US); Paul A. Moskowitz, Yorktown Heights, NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/679,033

(22) Filed: Oct. 4, 2000

Related U.S. Application Data

(63) Continuation-in-part of application No. 09/198,378, filed on Nov. 24, 1998, now Pat. No. 6,150,961.

(51) Int. Cl.[7] ..... G08G 1/123

(52) U.S. Cl. ..... 340/995; 340/989; 340/905; 701/117; 701/118; 701/119; 701/213; 380/271

(58) Field of Search ..... 340/995, 989, 340/905; 455/507, 509, 575; 701/117, 118, 119, 213; 380/271

(56) References Cited

U.S. PATENT DOCUMENTS

| | | | | |
|---|---|---|---|---|
| 4,689,747 | | 8/1987 | Kurose et al. | 701/200 |
| 5,138,321 | * | 8/1992 | Hammer | 342/36 |
| 5,164,904 | | 11/1992 | Sumner | 701/117 |
| 5,177,685 | | 1/1993 | Davis et al. | 455/456 |
| 5,187,810 | | 2/1993 | Yoneyama et al. | 455/509 |
| 5,428,544 | | 6/1995 | Shyu | 701/117 |
| 5,485,161 | | 1/1996 | Vaughn | 342/357.13 |
| 5,539,645 | | 7/1996 | Mandhyan et al. | 701/119 |
| 5,561,704 | | 10/1996 | Salimando | 455/456 |
| 5,572,401 | | 11/1996 | Carroll | 361/683 |
| 5,592,172 | | 1/1997 | Bailey et al. | 342/350 |
| 5,606,732 | | 2/1997 | Vignone, Sr. | 455/269 |
| 5,621,798 | | 4/1997 | Aucsmith | 380/271 |
| 5,669,061 | | 9/1997 | Schipper | 455/429 |
| 5,689,252 | | 11/1997 | Ayanoglu et al. | 340/991 |
| 5,699,255 | | 12/1997 | Ellis et al. | 701/212 |
| 5,726,893 | | 3/1998 | Schuchman et al. | 455/456 |
| 5,736,962 | | 4/1998 | Tendler | 342/357.1 |
| 5,737,700 | | 4/1998 | Cox et al. | 455/414 |

(List continued on next page.)

*Primary Examiner*—Benjamin C. Lee
(74) *Attorney, Agent, or Firm*—McGuireWoods, LLP; Stephen C. Kaufman

(57) ABSTRACT

A system of mobile units are installed in multiple vehicles in traffic, the vehicles with mobile units being a sample of all vehicles in traffic. These mobile units include both wireless communications devices and apparatus that determines the location of each vehicle. Monitoring a vehicle's position as a function of time also reveals the velocity of the vehicle. Position and speed information is periodically broadcast by the vehicles to a central monitoring station and to neighboring vehicles. At the central monitoring station, the collective input from the sample set of vehicles is processed using statistical analysis methods to provide an instant chart of traffic conditions in the area, the accuracy of said chart being within a range determined by the size of the sample. Warnings of delays or updates on traffic conditions on the road ahead are then automatically returned to subscribers of the information or are used as part of an Intelligent Vehicle Highway System (IVHS). Neighboring vehicles within a region communicating with one another form a network in which the broadcast information is processed locally on the respective vehicles to estimate possible problems ahead and consider computing an alternate road and/or checking with the central monitoring station for more information. If out of range of the central monitoring station, the vehicles in the network form a local area network for the exchange and update of information, and when any vehicle in the network is within range of the central monitoring station, the local area network data is uploaded to help update the overall traffic information.

19 Claims, 5 Drawing Sheets

U.S. PATENT DOCUMENTS 5,771,484 * 6/1998 Tognazzini ..... 701/117
5,926,101 7/1999 Dasgupta ..... 340/825.02
5,933,100 8/1999 Golding ..... 340/995
6,111,521 * 8/2000 Mulder et al. ..... 340/905

* cited by examiner

AUTOMATED TRAFFIC MAPPING USING SAMPLING AND ANALYSIS

This application is a Continuation in Part of application Ser. No. 09/198,378 filed on Nov. 24, 1998 entitled AUTOMATIC TRAFFIC MAPPING, now U.S. Pat. No. 6,150,961 which is hereby incorporated herein by reference.

BACKGROUND OF THE INVENTION

FIELD OF THE INVENTION

The present invention generally relates to the gathering and interpretation of information from mobile stations and, more particularly, to generating a map of traffic conditions from data collected from mobile units over a wireless link providing instant position data.

BACKGROUND DESCRIPTION

The gathering and interpretation of traffic information is a manual operation. Traffic information gathering services such as Metro Networks rely on human information sources; e.g., police and fire departments, traffic aircraft, reports phoned in by mobile units, and the like. The information is then interpreted and manually entered into a database. By the time the information gets to a user, it is often too late for the user to take advantage of the information. In many instances the information is no longer valid.

The Global Positioning System (GPS) uses a set of twenty-four orbiting satellites to allow ground-based users to determine their locations. Systems for automotive use have dropped in price to the point where they can be purchased for a few hundred to a few thousand dollars. These systems are either built in to the vehicle (e.g., the Cadillac On-Star system) or are portable in a lap top computer (e.g., the Delorme GPS Tripmate system). Such systems, however, are essentially passive, one way systems; that is, they provide the driver with position information based on GPS data. In the case of the On-Star system, there is an integrated cellular phone, but this is used only when actuated by the user or in case of an accident.

SUMMARY OF THE INVENTION

It is therefore an object of the present invention to provide a map of traffic conditions generated by data collected from mobile units over a wireless link providing instant position data.

It is another object of the invention to provide a map of traffic conditions which contains the instantaneous velocities of the mobile data collection units.

It is a further object of the invention to provide a warning system for mobile units based upon data held in the traffic map generated in accordance with the teachings of this invention.

It is yet another object of the invention to provide warnings sent to vehicles about to enter traffic jams or used in an Intelligent Vehicle Highway System (IVHS) system for the general public.

A further object of the invention is to use sampling and analysis techniques to generate traffic maps, using position data taken at different times from mobile units which are a sample of all vehicles in traffic, providing an accuracy for said traffic maps of all vehicles in traffic which is within a range determined by the size of the sample, the accuracy of the position data and the frequency with which the position data is taken.

According to the invention, there is provided a system of mobile units installed in, for example, vehicles in traffic. These mobile units include both wireless communications devices and apparatus (e.g., a GPS system) that determines the location of each mobile unit. Monitoring a mobile unit's position as a function of time also reveals the velocity of the mobile unit. Position and speed information is periodically broadcast by the vehicles to a central monitoring or base station and to neighboring mobile units.

At the central monitoring or base station, the collective input of a set of mobile units is processed to provide an instant chart of traffic conditions in the area. A mathematical analysis of data from a sampling of mobile units may be sufficient to give an accurate estimate of traffic patterns. Warnings of delays or updates on traffic conditions on the road ahead are then automatically returned to subscribers of the information or are used as part of an Intelligent Vehicle Highway System (IVHS).

Given a capability as herein described of sampling traffic conditions at different locations and different time periods, there are several methods which can be used to select a proper sample size and/or use a given sample to make statements (within a range of accuracy determined by the sample size) about the full population. These methods include, for example:

1. Classical Statistics as, for example, in "Probability and Statistics for Engineers and Scientists" by R. E. Walpole and R. H.

Myers, Prentice-Hall 1993; Chapter 8 and Chapter 9, where estimates of the mean and variance of the population are derived.

2. Bayesian Analysis as, for example, in "Bayesian Data Analysis" by A Gelman, J. B. Carlin, H. S. Stern and D. B. Rubin, Chapman and Hall 1995; Chapter 7, where several sampling designs are discussed.
3. Artificial Intelligence techniques, or other such techniques as Expert Systems or Neural Networks as, for example, in "Expert Systems: Principles and Programming" by J. Giarratano and G. Riley, PWS Publishing 1994; Chapter 4, or "Practical Neural Networks Recipes in C++" by T. Masters, Academic Press 1993; Chapters 15,16,19 and 20, where population models are developed from acquired data samples.

Neighboring mobile units within a region communicating with one another form a network in which the broadcast information is processed locally on the respective mobile units to estimate possible problems ahead and consider computing an alternate road and/or checking with the central monitoring or base station for more information. If out of range of the central monitoring or base station, the mobile units in the network form a local area network for the exchange and update of information, and when any mobile unit in the network is within range of the central monitoring base station, the local area network data is uploaded to help update the overall traffic information.

In addition to the central monitoring or base station, a plurality of relay stations can be installed to provide better coverage for an area or region of interest. The relay stations, having more power, can better transmit and relay data to and from the central monitoring or base station which might otherwise be out of range of some vehicles in the covered region. Alternatively or in addition to, a plurality of base stations may be connected in a larger area network, and mobile units communicate with a closest base station.

The general concept of the invention may be extended to multiple mobile units where there is a need to define a routing/hopping procedure. Each mobile unit must have a unique identifier (e.g., a mobile IP address). Hopping from unit to unit is based on the range (mobile units who can hear you or not) of the units. Each mobile unit tries to reach the closest base station by checking how many hops away each reachable unit is from a base station. When a probe signal reaches a base station, the signal percolates back to the mobile units which registers how many hops away it is from the base station. Routing across reachable mobile units is prioritized based on the hopping distance. Broken hopping chains are by-passed by the first unit in the chain that detects the missing element. When reaching a base station, a mobile unit can register to that base station so that messages can now be routed (e.g., percolated back) from base station to the unit. A header designates communication from and to the base station and broadcast or one-on-one messages (to neighboring mobile units). Mixed modes exist for the traffic mapping performed partially locally and by the central monitoring or base station. Local base stations may register connected devices to a global directory of the service provider for lager scale routing.

The user set may consist of a fleet of trucks, taxicabs, government service vehicles, or the customers of a wireless service provider. The customers may subscribe to a traffic information service that provides instant traffic condition updates based upon the reports of the whole user set. Discounts may be offered to those subscribers who join the information providing user set.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
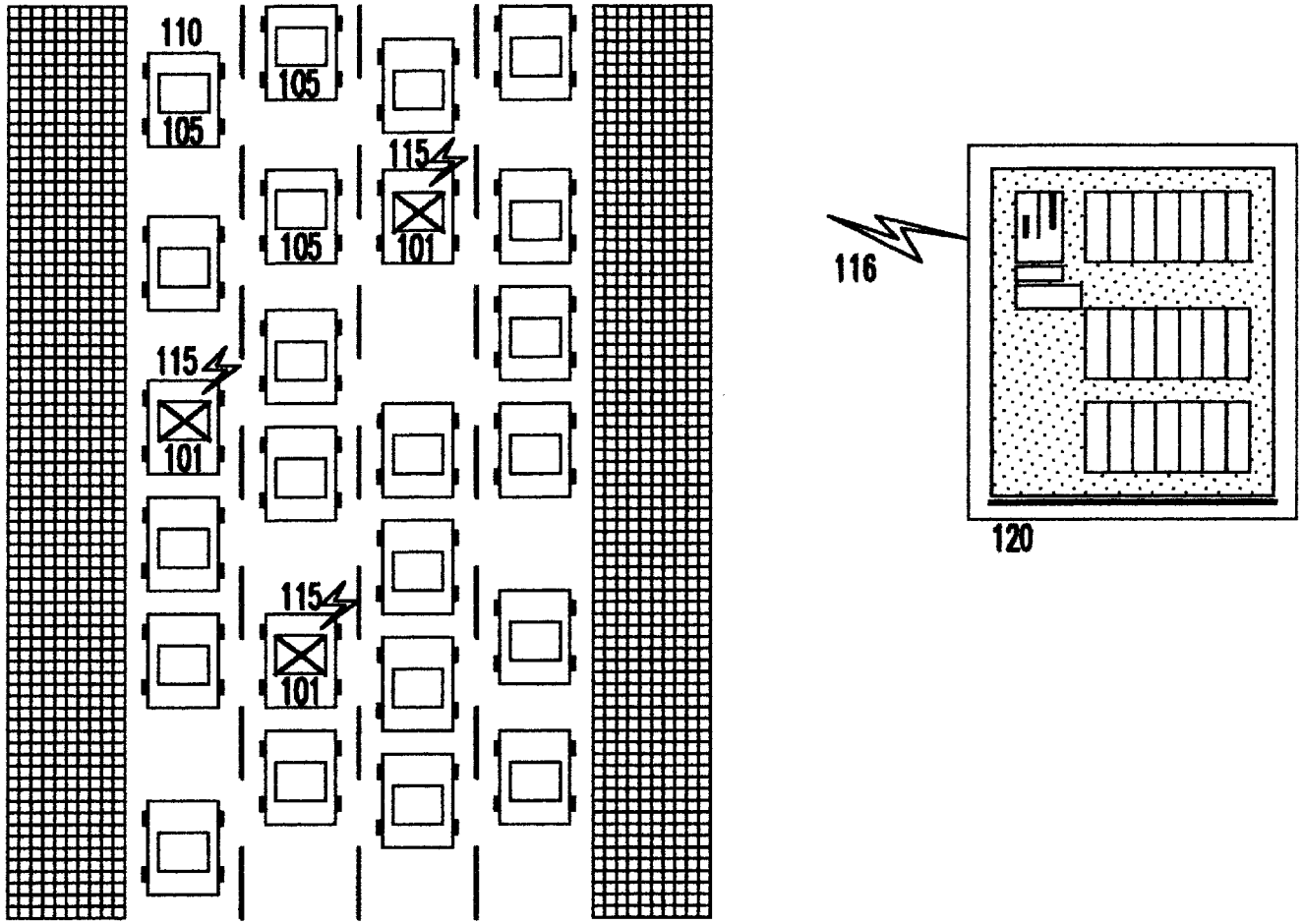
FIG. 1 is a simplified pictorial representation of an automated traffic mapping system including a plurality of vehicles with mobile units installed that communicate with a central monitoring station according to the invention.

Referring now to the drawings, and more particularly to FIG. 1, there is shown a plurality of vehicles on an expressway 110. Some of these vehicles 101, denoted with an "X", have mobile units installed, while the rest of the vehicles (e.g. 105) do not. The set of vehicles 101 may consist of a fleet of trucks, taxicabs, government service vehicles, or the customers of a wireless service provider.

The mobile units each include a wireless communication device, such as a cellular telephone, and apparatus, such as a GPS system, which determines the location of the vehicle in which it is installed. While a GPS receiver is the preferred location determining device, it will be understood that other location systems, such as those based on triangulation algorithms (e.g., LORAN (long-distance radio navigation system)), may be used. Position and speed information is periodically broadcast, as represented by the reference numeral 115. These broadcasts are received by neighboring vehicles and, as represented by the reference numeral 116, at a central monitoring station 120. Neighboring vehicles 101 within a region communicating with one another form a network in which the broadcast information is processed locally in the mobile units installed on the respective vehicles 101. If the vehicles 101 are out of range of the central monitoring station 120, the vehicles in the network form a local area network (LAN) for the exchange and update of information. The vehicles forming the LAN locally process the information broadcast by other vehicles in their region to generate a local traffic map of the region. When any one vehicle in the LAN is again within range of the central monitoring station 120, the LAN data is uploaded to help update the overall traffic information.

FIG. 1 may be viewed as an overall diagram of the architecture of the system. At the central monitoring station 120, the collective input of the set of vehicles 101 is processed to provide an instant chart of traffic conditions in the area. It is to be noted that the set of vehicles 101 is a subset of all vehicles in traffic. The other vehicles in traffic (e.g. 105) include the unmarked vehicles shown on FIG. 1. Depending on the size of the set of vehicles 101, a mathematical analysis of data from a sampling of all vehicles in traffic, as represented by the data taken at different times from set of vehicles 101, may be sufficient to give an accurate estimate of traffic patterns for all vehicles in traffic, in accordance with the mathematical techniques previously cited (e.g. classical statistics, Bayesian analysis, expert systems, neural networks, or artificial intelligence techniques), where the accuracy of said traffic pattern estimates for all vehicles in traffic is within a range determined by the size of the sample, the accuracy of the position data and the frequency with which the position data is taken. Warnings of delays or updates on traffic conditions on the road ahead are then automatically returned to vehicles 101 in the set from the central monitoring station 120. Alternatively, or in addition, the information may be used as part of an Intelligent Vehicle Highway System (IVHS).

Figure 2:
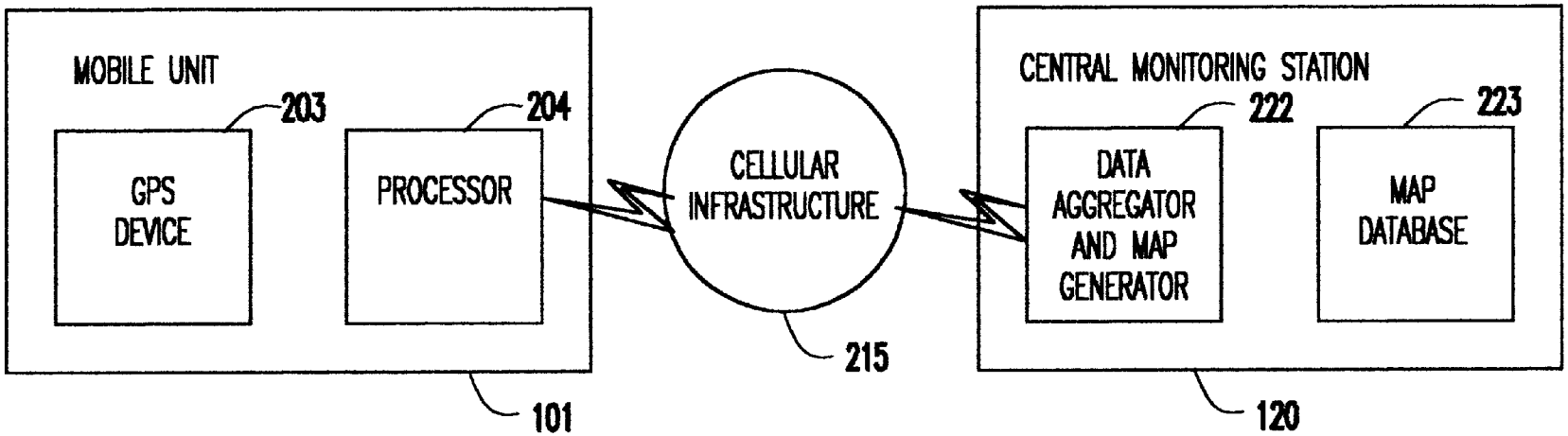
FIG. 2 is a block diagram of a mobile unit installed in a vehicle and the central monitoring system which communicates with the mobile unit via a cellular infrastructure.

Turning now to FIG. 2, there is shown the principle components of a mobile unit 101 in communication with the central monitoring station 120. In the preferred embodiment, the mobile unit includes a GPS device 203, typically a commercial unit which includes a self-contained antenna and receiver. Data from the GPS device 203 is passed to the central processing unit (CPU) 204 which computes and stores a current location of the vehicle from the GPS data. Monitoring the vehicle's position as a function of time also reveals the velocity of the vehicle. Alternatively, the CPU 204 may have an input from the vehicle's speedometer, which input is periodically sampled and stored. The stored data, i.e., the vehicles's current location and speed, is periodically broadcast via, for example, a cellular infrastructure 215.

The broadcast, in addition to being received by neighboring and similarly equipped vehicles, is received by the central monitoring station 120, which also receives the broadcasts of other vehicles in the set of vehicles. The data from each received broadcast is processed in a computer which implements a data aggregator and map generator function 222 which accesses a central map database 223. The data aggregator and map generator function 222 infers from the aggregate data input from the several vehicles in the set of vehicles 101 traffic congestion in the area and by accessing the map database 223 can generate alternative routes for individual vehicles in the set. The central monitoring station then broadcasts warnings of delays and updates of traffic conditions ahead together with alternate routes tailored for individual vehicles in the set, either automatically or upon request. In the case of a fleet of vehicles, such as delivery trucks, where the routes are known in advance, the alternate route information may be transmitted automatically. On the other hand, where set of vehicles 101 comprises subscribers whose routes are not known in advance, the alternate route information is transmitted upon request with information identifying a desired destination.

Figure 3:
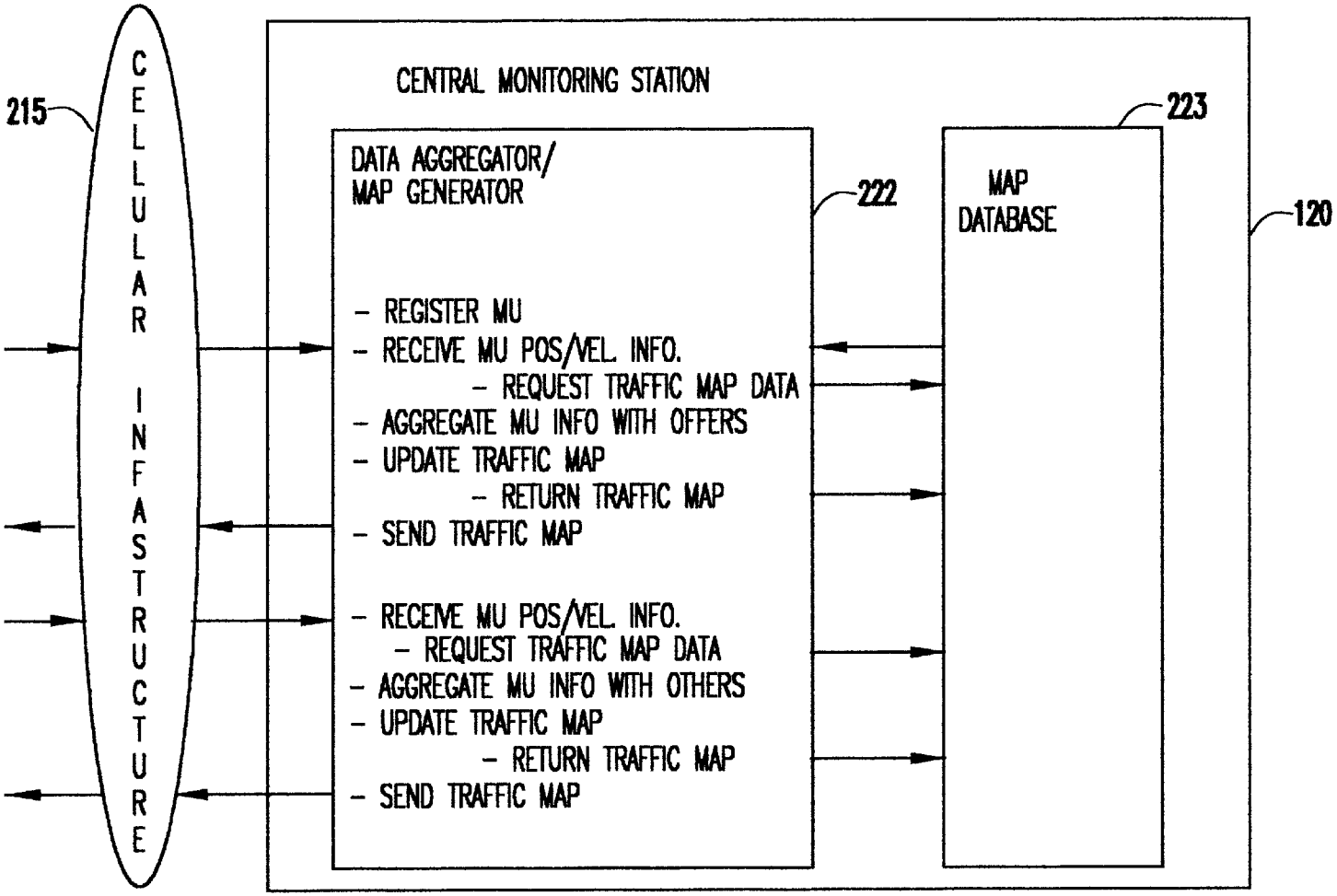
FIG. 3 is a block diagram of the central monitoring system showing the data flow of the data processing and mapping process implemented on a computer at the central monitoring station.

As shown in more detail in FIG. 3, the central monitoring station 120 when it receives a broadcast from a mobile unit (MU), the data received is registered or identified by specific mobile unit, and the position and velocity data from the mobile unit is stored with the mobile unit identification by the data aggregator and map generator function 222. The data aggregator and map generator 222 then requests traffic map data from the map database 223. The data received from the mobile unit is aggregated with data received from other mobile units, and the aggregate data is used to update the traffic map. The updated traffic map is then returned to the map database 223. The central monitoring station 120 then broadcasts the updated traffic map to the mobile units via the cellular infrastructure 215.

Figure 4:
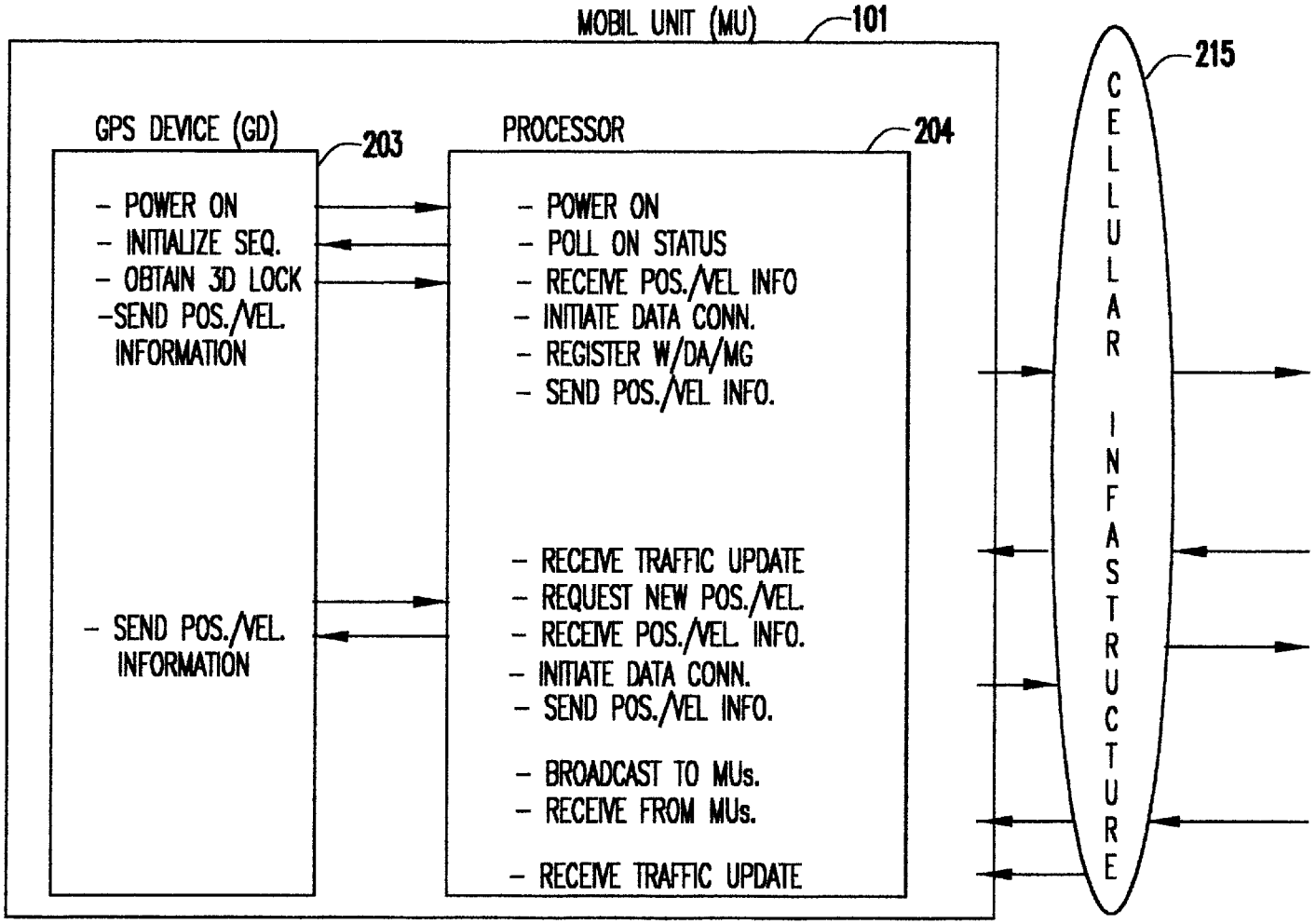
FIG. 4 is a block diagram of the mobile unit showing the data flow of the data processing and mapping process implemented on a central processor unit (CPU) in the mobile unit.

As shown in FIG. 4, the mobile unit 101 includes a GPS device 203 which, at power on, enters an initialize sequence. During this sequence, the GPS radio receives and identifies transmissions from a plurality of GPS satellites, and when a sufficient number of satellite transmissions have been acquired, obtains a three-dimensional lock on the vehicle position and velocity. Also at power on, the processor 204 polls the GPS device on status. When the three-dimensional lock has been acquired, the vehicle position and velocity data are input to the processor 204 in response to this poll.

As part of the power up sequence, the processor 204 also initiates a data connection with the cellular infrastructure 215. Periodically, the processor transmits via this connection to the data aggregator and map generator (DA/MG) function in the central monitoring station and to other mobile units. As part of this transmission, the processor registers its identification and sends the position and velocity information received from the GPS device 203. When a traffic update is received from the central monitoring station or from another mobile unit via the cellular infrastructure 215, the processor 204 requests new position and velocity information from the GPS device 203 and updates its local map.

Figure 5:
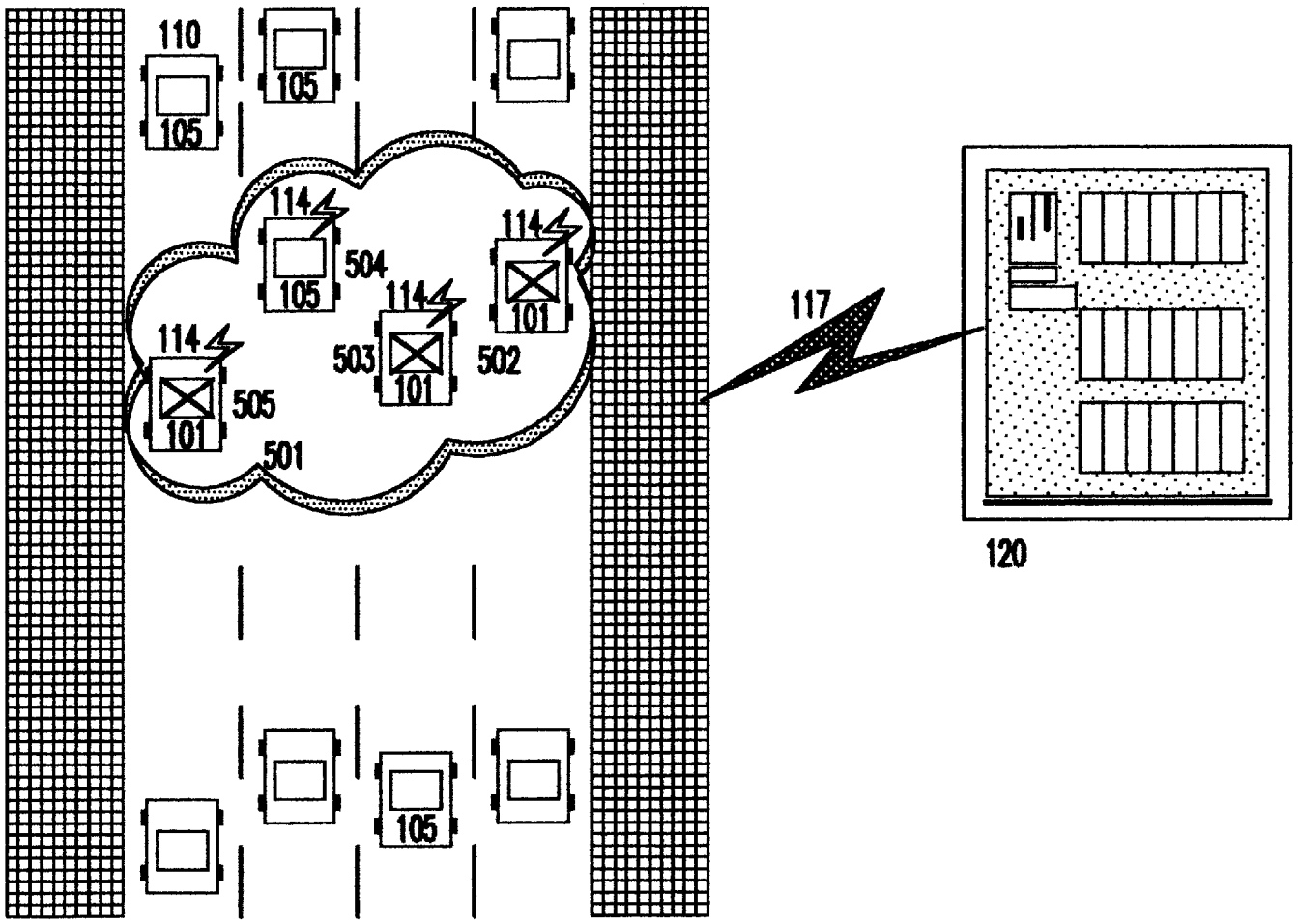
FIG. 5 is a simplified pictorial representation of an automated traffic mapping system including a plurality of vehicles with mobile units installed that communicate with each other and at least one communicates with a central monitoring station according to the invention.

FIG. 5 is similar to FIG. 1 in that of a plurality of vehicles on the expressway 110, some of the vehicles 101 denoted with an "X" have mobile units installed, while the rest of the vehicles 105 do not. As in FIG. 1, the mobile units have the ability to broadcast information and receive information, as represented by the reference numeral 114. However, in the example illustrated, only vehicle 502 is in range and able to communicate with the central station 120, as represented by the reference numeral 117. The vehicles that are out of range, e.g., 503, 504 and 505, may communicate with one another and with vehicle 502. Thus, the vehicles 101 may have their information relayed to and from the central monitoring station by vehicle 502. Additionally, if for example the vehicle 505 is out of range of vehicle 502 but is in range of vehicle 503 and vehicle 503 is in range of vehicle 502, the information from vehicle 505 may be relayed to the central monitoring station by successive relays; e.g., 505 to 503, 503 to 502, and finally 502 to central station 120. This process is referred to as "hopping" from vehicle to vehicle.

The vehicles that are in contact with the central monitoring station by a single or multiple hops form a collection or network 501. The collection or network may be configured into a local area network (LAN) or may be simply a diffuse collection of vehicles in which information flow hops from vehicle to vehicle. A routing/hopping procedure makes this possible.

Each mobile unit has a unique identifier (e.g., a mobile IP address). A mobile unit tries to reach the central monitoring station by checking how many hops away each reachable mobile unit is from the central monitoring station. When a probe signal reaches the central monitoring station, the signal percolates back to the mobile unit, which registers how many hops away it is from the central monitoring station. Routing across reachable mobile units is prioritized based on the hopping distance. Broken hopping chains are by-passed by the first mobile unit in the chain that detects a missing element. When reaching the central monitoring station, a mobile unit registers at the central monitoring station so that messages can now be routed (percolated back) from the central monitoring station to the mobile unit. A header in the communication frame designates communication from and to the base station and broadcast or one-on-one messages to neighboring mobile units. Mixed modes exist for example for the traffic mapping performed partially locally and by the central monitoring station.

The system may be further enhanced by the use of relay stations and/or multiple monitoring stations rather than a single central monitoring station. The use of relay stations would allow mobile units out of range of the central monitoring station to communicate with the central monitoring station via the relay station either directly or by hopping from one or more mobile units to the relay station. Multiple monitoring stations may be connected in a larger area network to provide greater coverage and allow for distributed processing among the multiple monitoring stations. Mobile units would register with a closest monitoring station, either directly or by hopping from one or more mobile units. The monitoring stations perform a distributed computational function of generating the map of traffic conditions or other relevant data processing function. It is also possible to distribute the traffic information processing function among the plurality of mobile units. This is done on a regional basis in the preferred embodiment where a plurality of mobile units are temporarily out of range of the central monitoring station. On a more global basis, the central monitoring station can be replaced by the distributed processing of all the mobile units in a wide area network (WAN) topology formed by a plurality of regional LANs that dynamically vary according to the hopping distances between vehicles.

While the invention has been described in terms of preferred embodiments, those skilled in the art will recognize that the invention can be practiced with modification within the spirit and scope of the appended claims. For example, the teachings of the invention may be applied to wireless communication among mobile units in buildings and underground structures, including a wireless/IR PDA network in a building. Other applications include person or fleet tracking, out of area wireless services, and beacon services (e.g., based on preferences, information can be provided to a user when a user comes within a given area).

Having thus described our invention, what we claim as new and desire to secure by Letters Patent is as follows:

1. An automated traffic mapping system comprising:

a plurality of mobile units installed in vehicles in traffic, each said mobile unit having both a wireless communications device and apparatus that determines location of a vehicle on which it is installed;

a central monitoring station receiving data from the plurality of mobile units and generating a map of traffic conditions; and a plurality of receivers installed in vehicles, each said receiver receiving transmissions from the central monitoring station and displaying traffic information, wherein said plurality of mobile units comprises a sampling of all vehicles in traffic, and wherein mathematical analysis of data from said plurality of mobile units is used to generate said map of traffic conditions, the results of said mathematical analysis being dependent upon data from each of said plurality of mobile units.

2. The automated traffic mapping system recited in claim 1 wherein the data received by the central monitoring station from the plurality of mobile units includes position data.

3. The automated traffic mapping system recited in claim 2 wherein the data received by the central monitoring station from the plurality of mobile units includes velocity data.

4. The automated traffic mapping system recited in claim 1 wherein said mathematical analysis is Bayesian analysis.

5. The automated traffic mapping system recited in claim 1 wherein said mathematical analysis uses an expert system.

6. The automated traffic mapping system recited in claim 1 wherein said mathematical analysis uses neural networks.

7. The automated traffic mapping system recited in claim 1 wherein said mathematical analysis uses classical statistics.

8. The automated traffic mapping system recited in claim 1 wherein said mathematical analysis uses artificial intelligence techniques.

9. The automated traffic mapping system recited in claim 1 wherein the apparatus that determines location of a vehicle is a Global Positioning Satellite (GPS) system.

10. The automated traffic mapping system recited in claim 1 wherein the central monitoring station includes a warning generation system which transmits warnings to mobile units installed in vehicles about to enter traffic jams.

11. The automated traffic mapping system recited in claim 1 wherein the central monitoring station includes a warning generation system which transmits warnings to an Intelligent Vehicle Highway System (IVHS).

12. A computer implemented method of automated traffic mapping comprising the steps of:

receiving at a central monitoring station data from a plurality of mobile units installed on vehicles;

generating a map of traffic conditions at the central station and transmitting traffic information to the mobile units; and receiving and displaying the traffic information at the mobile units, wherein said plurality of mobile units comprises a sampling of all vehicles in traffic, and wherein mathematical analysis of said data from said plurality of mobile units is used to generate said map of traffic conditions, the results of said mathematical analysis being dependent upon data from each of said plurality of mobile units.

13. The method of claim 12 wherein the data received by the central monitoring station from the plurality of mobile units includes position data.

14. The method of claim 13 wherein the data received by the central monitoring station from the plurality of mobile units includes velocity data.

15. The method of claim 12 wherein said mathematical analysis is Bayesian analysis.

16. The method of claim 12 wherein said mathematical analysis uses an expert system.

17. The method of claim 12 wherein said mathematical analysis uses neural networks.

18. The method of claim 12 wherein said mathematical analysis uses classical statistics.

19. The method of claim 12 wherein said mathematical analysis uses artificial intelligence techniques.

* * * * *